US006461067B1

(12) United States Patent
Beck et al.

(10) Patent No.: US 6,461,067 B1
(45) Date of Patent: Oct. 8, 2002

(54) WOOD-ENCASED PENCIL FOR WRITING, SKETCHING, DRAWING, AND COSMETIC PURPOSES

(75) Inventors: Udo Beck; Gerhard Lugert, both of Nürnberg; Walter Oetter, Stein, all of (DE)

(73) Assignee: A.W. Faber-Castell Unternehmensverwaltung GmbH & Co., Stein (DE)

( * ) Notice: Subject to any disclaimer, the term of this patent is extended or adjusted under 35 U.S.C. 154(b) by 0 days.

(21) Appl. No.: 10/014,266

(22) Filed: Nov. 7, 2001

Related U.S. Application Data

(63) Continuation of application No. PCT/EP99/09323, filed on Dec. 1, 1999.

(30) Foreign Application Priority Data

May 7, 1999 (DE) ..... 299 08 127 U
May 20, 1999 (DE) ..... 299 08 890 U

(51) Int. Cl.[7] ..... A46B 5/02
(52) U.S. Cl. ..... 401/7
(58) Field of Search ..... 401/6, 88, 195; 15/443; 156/60; 16/407, 410, 421, 430, DIG. 18, DIG. 19

(56) References Cited

U.S. PATENT DOCUMENTS 5,735,622 A * 4/1998 Melnick et al. ..... 401/88 X

FOREIGN PATENT DOCUMENTS

| | | | | |
|---|---|---|---|---|
| DE | 34 06 521 A 1 | | 8/1985 | |
| DE | 3406522 | * | 9/1985 | ..... 401/6 |
| FR | 2 622 512 | | 5/1989 | ..... 401/6 |
| JP | 08197882 | | 8/1996 | |
| JP | 09039467 | | 2/1997 | |

OTHER PUBLICATIONS

International Search Report for PCT/EP99/09323, issued by the European Patent Office on Apr. 27, 2000.

* cited by examiner

*Primary Examiner*—Gregory L. Huson
*Assistant Examiner*—Kathleen J. Prunner
(74) *Attorney, Agent, or Firm*—Laurence A. Greenberg; Werner H. Stemer; Gregory L. Mayback

(57) ABSTRACT

A wood-encased pencil has raised structures formed of a synthetic material. The raised structures project above the surface at which the pencil is held and the structures form handling or gripping surfaces to increase the gripability of the pencil. The raised structures are formed by applying to the pencil an initially flowable plastic composition that later solidifies to form the raised structures. The plastic composition has, as a principal constituent, an aqueous polymer dispersion that hardens to become water-resistant.

12 Claims, 1 Drawing Sheet

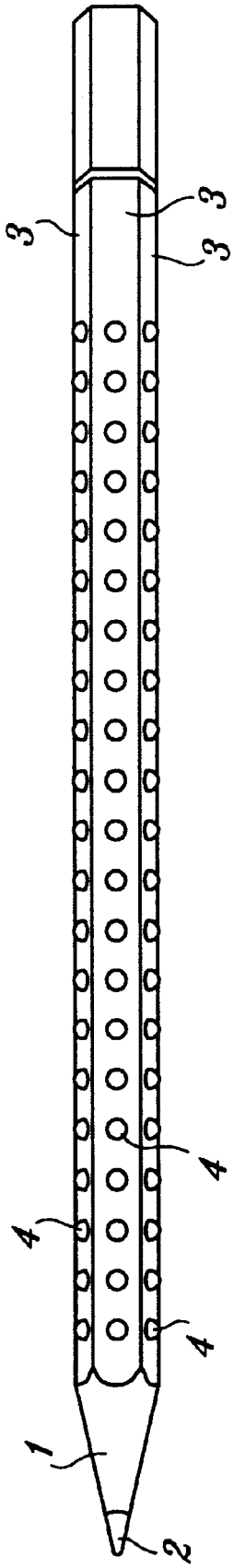
3
3
3
4
4
4
1
2

WOOD-ENCASED PENCIL FOR WRITING, SKETCHING, DRAWING, AND COSMETIC PURPOSES

CROSS-REFERENCE TO RELATED APPLICATION

This application is a continuation of copending International Application No. PCT/EP99/09323, filed Dec. 1, 1999, which designated the United States.

BACKGROUND OF THE INVENTION

Field of the Invention

The invention relates to a wood-encased pencil for writing, sketching, drawing and cosmetic purposes. Pencils of this type generally have a wooden jacket accommodating a lead in the center. As used herein, the term "pencil" includes pencil-shaped holders for leads, so-called mechanical pencils.

Wood-encased pencils generally have smooth surfaces formed by a coat of paint. Holding the pencil is therefore associated with relatively great application of force, which causes fatigue on extended use. Japanese patent disclosure JP 9-39467 describes a sleeve consisting of plastic or metal which forms the region of a pencil-like applicator that is close to the point and on whose peripheral surface raised structures are present. These consist of a polyurethane resin and are applied to the sleeve surface by screen printing.

SUMMARY OF THE INVENTION

It is accordingly an object of the invention to provide a wood-encased pencil for writing, painting, sketching, drawing, and cosmetics application, which overcomes the above-mentioned disadvantages of the heretofore-known devices and methods of this general type and which is improved in ergonomic respects.

With the foregoing and other objects in view there is provided, in accordance with the invention, a wood-encased pencil, for example for writing, sketching, drawing, and cosmetic purposes. The pencil comprises:

a pencil body formed with a handling surface; and raised structures on the handling surface for facilitating holding the pencil body, the raised structures being applied as an initially flowable plastic composition that later solidifies to form the raised structures, and the plastic composition comprising, as principal constituent, an aqueous polymer dispersion, or a mixture of dispersions, that hardens to become water-resistant.

In other words, the objects of the invention are achieved with a pencil whose grip surface has raised structures of a plastic material forming grip surfaces or grip nubs. The structures project from the peripheral surface of the pencil in raised nubs or the like which enable, firstly, the diameter of the pencil to be increased without impairing the ability of the pencil to be sharpened in the standardized sharpening cones of conventional sharpeners. This applies in particular in the case of hexagonal pencils, wherein the raised structures are arranged on the flattened-off surface areas. Secondly, the gripability of the pencil is increased merely through the presence of the raised structures. A further improvement in the gripability and the tactile properties can be achieved by a corresponding plastic material. The raised structures with which at least the front third of the pencil is preferably provided are applied to the pencil surface in the form of an initially flowable plastic composition, the plastic composition subsequently solidifying or being capable of solidification.

The plastic composition is an aqueous polymer dispersion which hardens in a water-resistant manner or a mixture of such dispersions. With respect to adhesive strength, ability to be sharpened, ergonomy and toxicology of the raised structures or plastic composition, particularly good results are obtained with dispersions which comprise a polymer or copolymer from the group consisting of polyurethane, polyacrylate, polystyrene, polyvinyl acetate and polyester-polyurethane. Dispersions or polymers of this type can very generally be solidified by simple drying. However, it is also conceivable for the polymers to contain UV-crosslinkable functional groups. Solidification of the plastic material is then possible in a relatively short time. The viscosity of the initially liquid plastic composition can be adjusted by means of thickeners and also by means of fillers and auxiliaries.

The solids content of the polymer dispersions is preferably in the range from 30 to 65% by weight. By means of dispersions of this type, both the viscosity of the starting plastic composition and also the consistency of the later raised structures can be adjusted through variation of the filler and thickener content. The plastic composition has an uncured starting state which comprises from 30 to 95% by weight of the polymer dispersion and a remainder of fillers and auxiliaries. The plastic composition, in the uncured starting state, comprises in % by weight a polymer dispersion of 40 to 90%, a filler of 0 to 40%, and the remainder being auxiliaries. The fillers used are preferably kaolin talc barium sulfate, titanium white, calcium carbonate and mica. In addition, advantageous fillers are those with which the flexibility, the elasticity, the porosity and the tactile properties of the raised structures can be varied in a targeted manner. Fillers of this type are, in particular, hollow aluminum silicate beads, expanded hollow beads, soft- feel PU beads, micronized plastics, such as polypropylene or PTFE, and PE waxes.

Suitable colorants are, in particular, pigment preparations having pigment contents of from 15 to 75% by weight. The viscosity of the aqueous starting plastic composition, which depends on the desired height of the raised structures and on the type of applicator used, is less than 40000 mpa·s (250°C., spindle 64, 25 rpm, Brookfield).

The thickeners used are preferably associative thickeners, such as PU polyethers and, PU polyols. Also possible, however, are non-associative thickeners, those based on acrylate and other thickeners, such as modified bentonites.

Other features which are considered as characteristic for the invention are set forth in the appended claims.

Although the invention is illustrated and described herein as embodied in a wood-encased pencil for writing, sketching, drawing and cosmetic purposes, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

FIG. 1 is an elevational view of the pencil according to the invention.

DESCRIPTION OF THE PREFERRED EMBODIMENTS

Referring now to the FIGURE of the drawing in detail and first, particularly, to FIG. 1 thereof, there is shown a pencil with a pencil body having a wooden jacket and a pencil lead 2. The pencil has a hexagonal contour, defined by otherwise flat hexagon surfaces 3 forming a handling surface. Raised structures in the form of nubs 4 project from the individual hexagon surfaces 3 essentially in the radial direction. Instead of nubs, other structures may be applied to the pencil surface, for example, strip-like structures extending in the longitudinal direction of the pencil. It is also conceivable for the raised structure to extend around the pencil periphery in a ring shape. The raised structures or nubs 4 may be applied either to an uncolored wood surface or alternatively to a paint coat.

Some exemplary and illustrative formulations for suitable plastic compositions will be provided in the following text.

The percentages relate to the plastic composition in the flowable, i.e, as yet unhardened, starting state. All percentages are percent by weight, unless stated otherwise.

EXAMPLE 1

| | |
|---|---|
| Acrylate dispersion | 55% |
| Water | 29.8% |
| Pigment Blue 15:1, C.I. 74160 (Luconyl G blue 6900; BASF AG) | 8% |
| Propylene glycol | 5% |
| Thickener: Rheolate ® 420 (RHEOX Europe NV/SA) | 1.7% |
| Surfactant: FC 171 (3M) | 0.5% |
| Antifoam: Foamex ® N (Tego ®) | 0.2% |

The acrylate dispersion is composed of 15% by weight of STX-1532 and 40% of Joncryl 537. Both dispersions are marketed by Johnson. A plastic composition of this type was applied by roller to three of the hexagon grip surfaces of a hexagonal pencil in a layer thickness of about 0.2 mm.

EXAMPLE 2

| | |
|---|---|
| Acrylate-styrene polymer dispersion | 90% |
| Flow-control agent: | |
| Butyl glycol | 4.8% |
| Mica | 3% |
| Talc | 2% |
| Antifoam: | |
| Foamex ® N (Tego ®) | 0.2% |

The acrylate-styrene dispersion is a dispersion based on an modified anionic acrylate-styrene copolymer and is available from Zeneca® under the name NeoCry® XK-70. A painted wooden pencil was sprayed with the stated plastics composition over the full circumference on two-thirds of its length. This operation was repeated after drying each preceding layer. In this way, a grip zone having a thickness of about 0.5 mm was achieved. Instead of the spraying, the grip zone can also be produced by dipping the pencil into the plastic composition with its front region. In order to achieve greater layer thicknesses, repeated dipping is advantageous.

EXAMPLE 3

| | |
|---|---|
| Polyurethane dispersion | 66% |
| Kaolin | 20% |
| Pigment Yellow 74, C.I. 11741 (Levanyl Yellow 5 GXLF (BAYER AG)) | 6.4% |
| Dispersant and flow-control agent: | |
| Sokalan ® PA 15 (BASF AG) | 3.4% |
| Wetting agent: | |
| Agitan ® 285 (Münzing-Chemie) | 3% |
| Thickener: | |
| Rheolate ® 205 (RHEOX Europe NV/SA) | 0.6% |
| Antifoam: | |
| T 4202 (Drew) | 0.3% |
| Foamex ® N (Tego ®) | 0.3% |

A plastic composition of this type was applied in drop form to painted and unpainted pencils. After drying, nubs formed on the pencil surface. The viscosity and the parameters of the applicator were set in such a way that nubs having a diameter of about 1 mm under a nub height of up to 0.3 mm were achieved.

EXAMPLE 4

| | |
|---|---|
| Polymer dispersion | 46% |
| Water | 15% |
| Barium sulfate | 13% |
| Pigment Red 112, C.I. 12370 (Sandospers Red E-GRS from Clariant AG) | 10% |
| Further filler: | |
| Propyltex 100 S (Micropowders Inc.) | 8% |
| Flow-control agent: | |
| Propylene glycol | 5.8% |
| Thickener: | |
| Rheolate ® 420 (RHEOX Europe NV/SA) | 1% |
| Wetting agent: | |
| Triton ® CF-10 (Union-Carbide Corp.) | 1% |
| Antifoam: Foamex ® N (Tego ®) | 0.2% |

The above formulation is an example of a red plastic composition based on an aqueous, plasticizer-free, finely disperse copolymer dispersion comprising acrylates and styrene with a low residual monomer content. The plastic dispersion has a solids content of about 50% and a pH of from 6.5 to 8%. The plastic composition was used to apply oval nubs to wood-encased pencils through slit-shaped nozzles.

We claim:

1. A wood-encased pencil, comprising:

a pencil body formed with a handling surface; and raised structures on said handling surface for facilitating holding said pencil body, said raised structures being applied as an initially flowable plastic composition that later solidifies to form said raised structures, and said plastic composition comprising, as principal constituent, an aqueous polymer dispersion that hardens to become water-resistant.

2. The pencil according to claim 1, wherein said raised structures form grip surfaces.

3. The pencil according to claim 1, wherein said raised structures form grip nubs.

4. The pencil according to claim 1, wherein said aqueous polymer dispersion is a mixture of dispersions hardening to become water-resistant.

5. The pencil according to claim 1, wherein said polymer dispersion has a polymer or copolymer selected from the group consisting of polyurethane, polyacrylate, polystyrene, polyvinyl acetate, and polyester-polyurethane.

6. The pencil according to claim 1, wherein said polymer dispersion contains UV-crosslinkable functional groups.

7. The pencil according to claim 1, wherein said polymer dispersion comprises a thickener.

8. The pencil according to claim 1, wherein said polymer dispersion comprises a filler.

9. The pencil according to claim 1, wherein said polymer dispersion has a solids content of from 30 to 65% by weight.

10. The pencil according to claim 9, wherein said plastic composition has an uncured starting state which comprises from 30 to 95% by weight of said polymer dispersion and a remainder of fillers and auxiliaries.

11. The pencil according to claim 10, wherein said plastic composition in the uncured starting state comprises, in % by weight:

polymer dispersion 40 to 90% filler 0 to 40% auxiliaries remainder.

12. The pencil according to claim 1, which comprises a lead and is configured for an activity selected from the group consisting of writing, sketching, drawing, and cosmetic purposes.

* * * * *